United States Patent [19]

Hafstrom

[11] 4,452,054

[45] Jun. 5, 1984

[54] AGITATOR THRUSTER FOR AN AUTOMATIC WASHER

[75] Inventor: Warren R. Hafstrom, Stevensville, Mich.

[73] Assignee: Whirlpool Corporation, Benton Harbor, Mich.

[21] Appl. No.: 320,736

[22] Filed: Nov. 12, 1981

[51] Int. Cl.[3] ..... D06F 17/08; D06F 17/10

[52] U.S. Cl. ..... 68/133; 68/134; 74/57

[58] Field of Search ..... 68/23.6, 133, 134; 366/319, 323, 278, 332; 74/57, 58, 99 A

[56] References Cited

U.S. PATENT DOCUMENTS

| | | | |
|---|---|---|---|
| 1,764,302 | 6/1930 | Hauser | 68/23.6 |
| 2,246,733 | 6/1941 | Kiefer | 74/57 |
| 2,300,055 | 10/1942 | McCabe | 68/134 X |
| 2,503,158 | 4/1950 | Lane | 68/133 |
| 2,770,119 | 11/1956 | Walton | 68/28 |
| 3,678,714 | 7/1972 | Krolzick | 68/131 |
| 4,127,015 | 11/1978 | Platt et al. | 68/134 X |
| 4,193,275 | 3/1980 | Bochan | 68/134 |

FOREIGN PATENT DOCUMENTS

| | | | |
|---|---|---|---|
| 156108 | 4/1954 | Australia | 68/134 |
| 687918 | 2/1940 | Fed. Rep. of Germany | 74/57 |

*Primary Examiner*—Philip R. Coe
*Assistant Examiner*—Christine A. Peterson
*Attorney, Agent, or Firm*—Hill, Van Santen, Steadman & Simpson

[57] ABSTRACT

An agitator thruster is provided for an automatic washer for increasing the rollover of clothes during the agitation portion of a washing cycle wherein the thruster moves in a vertical reciprocating motion by using inner and outer reversely spiraled cam surfaces and a driving barrel having a driving pin which alternately transfers to the inner and outer cam surfaces.

7 Claims, 8 Drawing Figures

FIG. 1
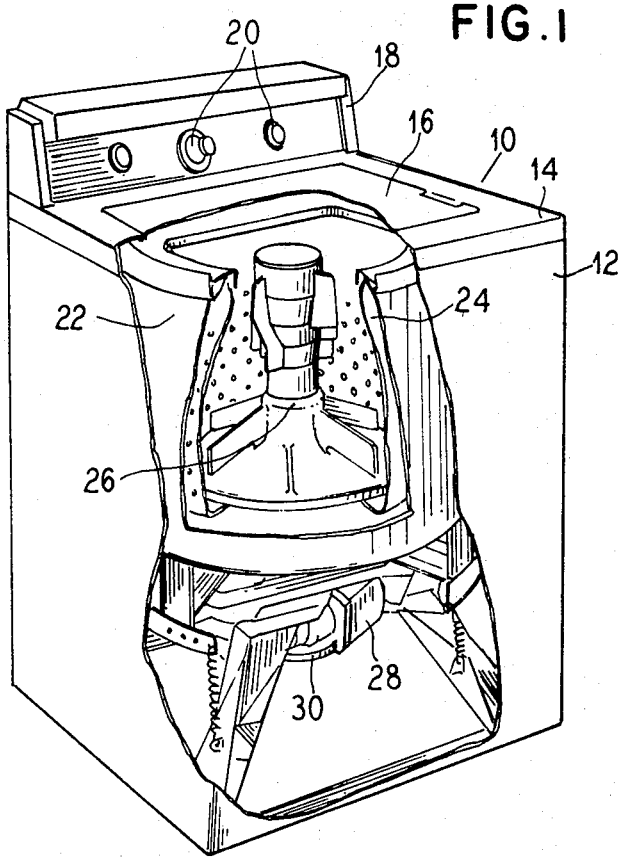
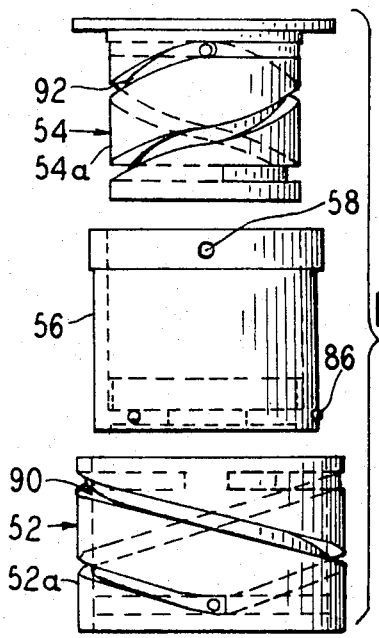
FIG. 8
FIG. 3
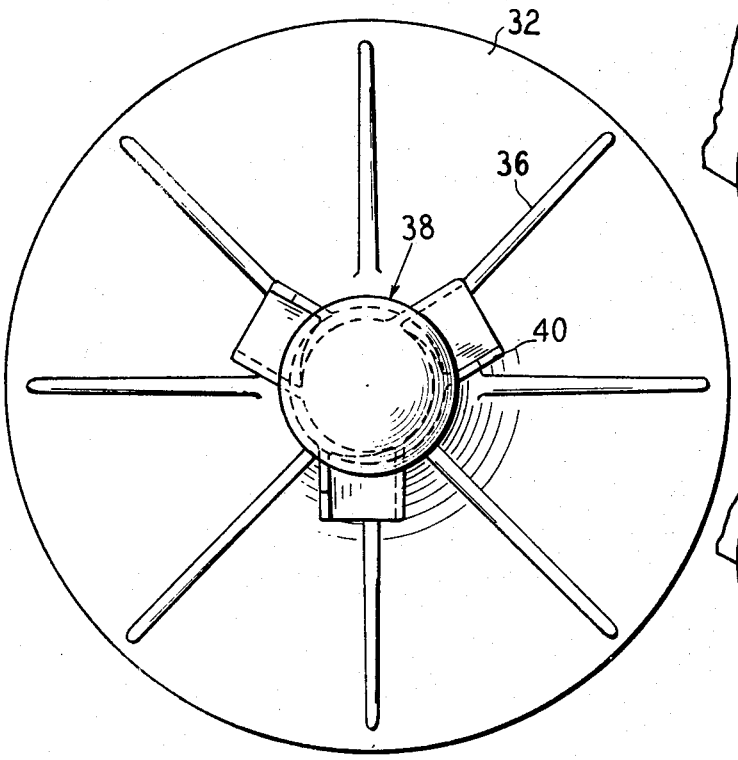
FIG. 6
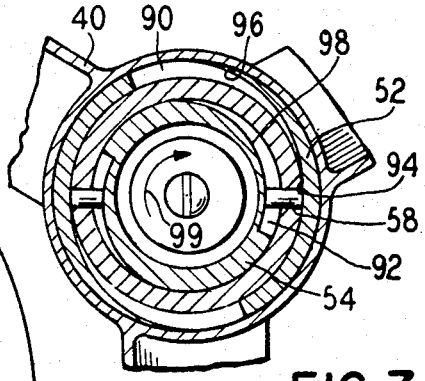
FIG. 7
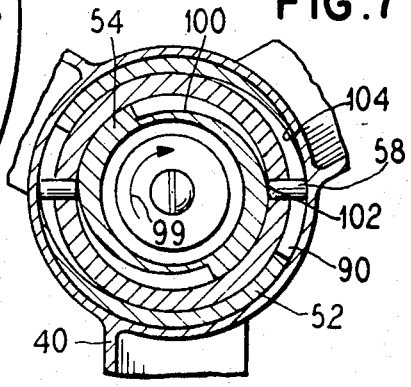

AGITATOR THRUSTER FOR AN AUTOMATIC WASHER

BACKGROUND OF THE INVENTION

1. Field of the Invention

This invention relates to an automatic washing machine agitator construction and more specifically to an agitator construction wherein the agitator is comprised of an oscillatory rotating portion and a vertically reciprocating portion.

2. Description of the Prior Art

A number of different types of agitating structures are disclosed in the prior art for automatic washing machines which provide both reciprocatory and rotary movement of an agitator. For example, U.S. Pat. Nos. 3,678,714 and 4,193,275 both disclose thrusters that are driven in reciprocating motion by the oscillatory motion of the agitator shaft. In the '714 patent, the thruster is driven by driving lugs riding on a cam member. In the '275 patent the thruster is driven by a screw thread on the agitator shaft when the force of the clothes in the basket prevent rotational movement of the thruster. Both thrusters disclosed have a reciprocation period equal to or greater than the oscillation period of the agitator.

SUMMARY OF THE INVENTION

The purpose of the present invention is to provide an improved washing action by increasing the rollover of the articles to be washed. This improved washing action is accomplished by means for securing both oscillation and vertical reciprocation in an agitator element. The agitator is particularly designed for those types of washing machines which include perforate basket assembly connected to a vertically disposed shaft, with an oscillating agitator being disposed in the perforate basket and having a shaft which is concentric with the shaft which rotates the perforate basket. Drive means are provided to selectively drive the perforate basket continuously in a wash liquid extraction stage, and to oscillate the agitator vanes during the washing cycle.

In accordance with the present invention, a secondary agitator provides vertical movement in the wash liquid during agitation. The preferred form of the invention involves the use of a one-way clutch mechanism to provide intermittent rotary motion to unidirectionally drive a drive barrel in the agitator. The drive barrel contains driving lugs which engage inner and outer cam surfaces in the barrel of the agitator thruster. When the thruster barrel is restrained against movement by a clothes load adjacent the barrel, the lugs engage the cam as the barrel rotates. The resultant force raises and lowers the thruster barrel. At the ends of each cam stroke the lugs transfer back and forth between the inner cam barrel and the outer cam barrel.

Through the use of the combined reciprocation and oscillation, an improved washing action is obtained through the increase rollover of the articles being washed. Because of this improved washing action, a larger capacity load can be washed than would be possible with a conventional agitator which provides only rotary oscillation. The present invention produces the required rollover of a heavy clothes load within acceptable power usage requirements.

The inner and outer cam barrels are indexed to each other and secured coaxially whereby the driver barrel which houses the drive lugs will rotate between the inner and outer cam barrels. The reciprocating action is positive and smooth and provdes great cam variation configuration and stroke length to satisfy any possible washer configuration and requirement. Also, the period of reciprocation can be changed throughout a wide range.

BRIEF DESCRIPTION OF THE DRAWINGS

FIG. 1 is a perspective view of a washing machine embodying the present invention, partially cut-away to show the interior mechanism thereof.

FIG. 3 is a top elevational view of the agitator shown in FIG. 2.

FIG. 6 is a partial sectional view of the cam driving arrangement taken generally along the lines VI—VI of FIG. 2.

FIG. 7 is a partial sectional view of the cam driving arrangement with the thruster in the upper most position as distinguished from the view shown in FIG. 6.

FIG. 8 is an exploded side view of the inner cam barrel, the driving barrel and the outer cam barrel.

DESCRIPTION OF THE PREFERRED EMBODIMENTS

Figure 2:
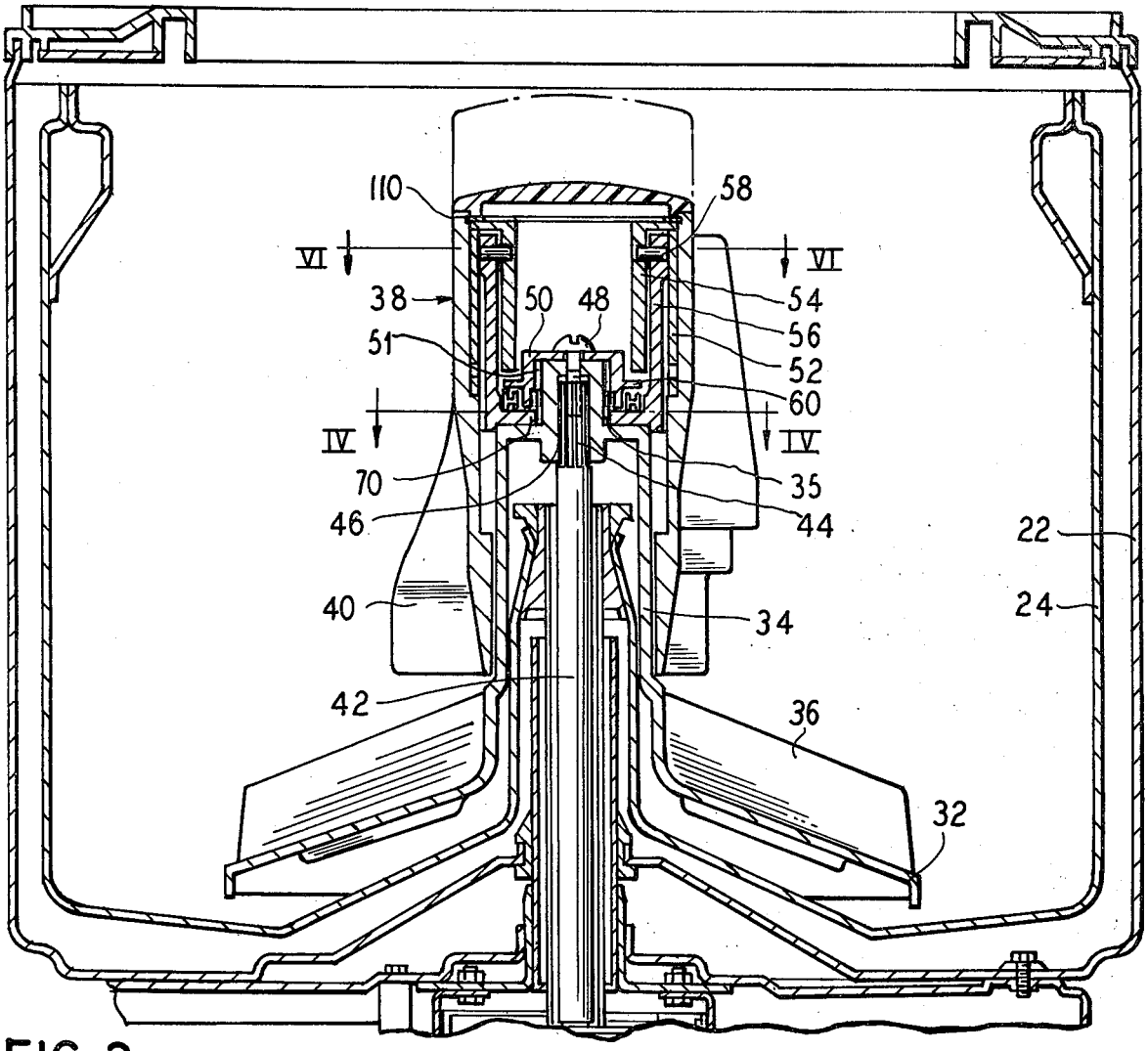
FIG. 2 is a side sectional view of the agitator assembly within the tub and basket of the washing machine.

A laundry appliance 10 comprising an automatic clothes washer embodying the principles of the present invention is depicted in FIG. 1. The washer is comprised of a cabinet 12 having a top 14 with a lid 16 and a console 18 having presettable controls 20 thereon of the type wherein an operator may preselect a program of automatic washing, rinsing and drying steps in a laundering process. The lid 16 in the top 14 of the cabinet 12 permits access into the top of a tub 22 housed within the cabinet 12. Enclosed and supported within the tub 22 is a clothes container or spin basket 24 within which is oscillatably mounted an agitator 26.

Below the tub 22 but within the cabinet 12 there is provided an electric motor 28 which oscillatably drives the agitator 26 through a transmission 30. The agitator 26 is shown in greater detail in FIGS. 2 and 3 where it is seen that the agitator 26 is comprised of a skirt portion 32 near the bottom of the agitator and a substantially vertical barrel portion 34 integrally connected with the skirt and projecting upwardly therefrom. A plurality of pumping vanes 36 are provided around the periphery of the barrel 34 and extend downwardly and outwardly along the skirt portion 32 of the agitator 26.

A thruster portion 38 of the agitator is mounted concentrically about the barrel portion 34 and above the pumping vanes 36. The thruster portion 38 has a plurality of thrusting vanes 40 provided around the periphery of the thruster 38 which extend downwardly and outwardly along the entire length of the thruster portion 38.

A drive shaft 42 for the agitator extends upwardly through the barrel portion 34 of the agitator and is drivingly connected to the barrel portion by means of a splined end 44 matingly engaging a coversely shaped opening 46 in the barrel 34. Fastening means 48 such as a screw retains the splined connecting portions in a fixed axial relationship. The fastening member 48 also retains a splined cap 50 driven by splines 35 on barrel 34 mating with splines 51 on cap 50 for oscillatory movement with barrel 34. Thus, oscillation of the drive shaft 42 oscillates the barrel 34 via the splined conections 44, 46 on the drive shaft 42 and the barrel 34 which also drives cap 50 in oscillation.

Carried within the top portion of the thruster 38 is an outer cam barrel 52, an inner cam barrel 54 and a driving barrel 56 positioned concentrically between the inner and outer cam barrels 52, 54. Two driving lugs 58 are carried in the drive barrel 56 and alternately engage cam surfaces 90 and 92 in the cam barrels 52, 54.

Figure 4:
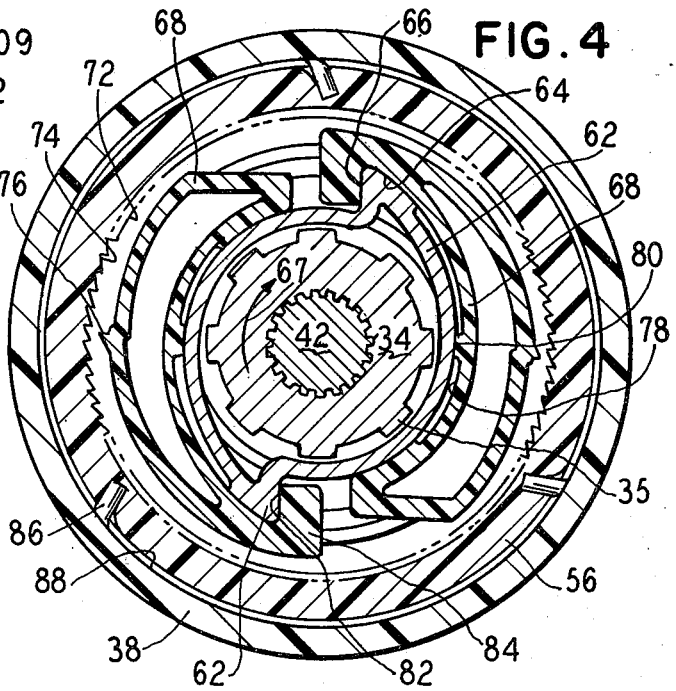
FIG. 4 is a sectional view of the one-way clutch mechanism taken generally along the lines IV—IV of FIG. 2.

As shown in FIG. 4, the drive barrel 56 is driven by means of the drive shaft 42 in accordance with the principles of the invention disclosed in U.S. Pat. No. 4,164,130. In particular, the drive shaft 42 is drivingly connected through barrel 34 to drive cap 50 as previously explained. The cap 50 is formed with a radially extending flange 60 and, below the flange 60, a pair of cam lobes 62. The cap 50, the flange 60, and the cam lobes 62 together form an oscillating member which rotates with the drive shaft 42, the upstanding barrel 34, the skirt 32 and the vanes 36.

Each of the cam lobes 62 is formed with a first, driving surface 64 extending generally in a circumferential direction, and a second, capture surface 66 extending generally in a radial direction. The driving surface 64 comprises a spiral which proceeds radially inwardly in the direction of the driving rotation shown by arrow 67. The capture surface 66 is tilted forwardly in the direction of the non-driving rotation from a line radial to the axis of the assembly.

Carried outwardly of the cam lobes 62 are a pair of clutch shoes or members 68. Each clutch shoe 68 is retained axially about the cam lobe 62 between the flange 60 and an upper side of a support rim 70 of the driving barrel 56. The clutch shoes 68 are restrained from radially outward movement by surrounding cylindrical engagement surface 72 formed on an inner surface of the driving barrel 56. The engagement surface 72 of the driving barrel 56 is preferably toothed as at 74, and each clutch shoe 68 carries on a radially outer surface thereof at least one corresponding tooth 76 engageable therewith for a positive driving connection. More than tooth 76 may be provided on each shoe 55 if desired, although one is sufficient.

A radially inward part of each clutch shoe 68 is formed with a first, curved surface 78 extending radially inwardly in the direction of driving oscillations, the surface 78 corresponding to the driving surface 64 of each cam lobe 62. It is preferred that the surfaces 64 and 78 have cooperating spacers 80 extending radially of the surfaces to reduce surface contact area between them to avoid sticking of the parts should they become wet in the washing machine environment.

Each clutch shoe 68 has a further, capture surface 82 formed on a shoulder 84 at a circumferentially forward end thereof in the direction of non-driving rotation. The surface 82 is aligned with the capture surface 66 of the cam lobe 62. The forward tilting of the surfaces 66, 82 in the non-driving direction assures that the clutch shoes 68 are cammed radially inwardly when the drive shaft 42 and connected parts rotate in such non-driving direction. Such capture and camming action removes the teeth 76 from engagement with the teeth 74 of the drive barrel 56. Since the shoes 68 are withdrawn radially inwardly from the teeth 74 of the inner surface 72 of the drive barrel 56, no ratcheting occurs, providing a substantially noiseless clutch action. In this manner, the drive barrel 56 is unidirectionally rotated by means of the one-way clutching arrangement.

The drive barrel 56 acts through the drive lugs 58 and the inner and outer cam barrels 52 and 54 to drive the thruster 38 in an axially reciprocating motion. The clothes and water within the basket 24 provide the restraining force required on the thruster 38 to prevent its rotational movement, thus forcing the rotational movement of the drive barrel to be changed into vertical motion of the thruster. To provide additional friction to overcome any reverse rotational forces and to reduce the amount of friction required of the clothes load in the basket, a plurality of resilient fingers 86 are provided around the periphery of the driving barrel 56 which engage with an inner surface 88 of the thruster 38.

As seen in FIGS. 6, 7 and 8, the driving barrel 56 is nested between the outer cam barrel 52 and the inner cam barrel 54. The outer cam barrel 52 has a cam surface 90 which is arranged in a spiral manner through the cylindrical wall **52*a* of the outer cam barrel 52. The cam surface 90 may be arranged about the inner surface of the outer cam barrel 52 if desired. The inner cam barrel 54 has a cam surface 92 arranged in a spiral manner about the exterior surface of the inner cam barrel 54 and in a reverse spiral direction from the cam surface 90 of the outer cam barrel 52. The cam surfaces 90, 92 alternately receive the drive lugs 58 as the agitator rotates. The drive lugs are transferred from engagement with the cam surface 90 of the outer cam barrel 52 to the cam surface 92 of the inner cam barrel 54 and back again by means of ramps 94 and 104 located at transfer areas over the inner and outer cam barrels. The cam surfaces 90, 92** can be of various configurations to provide a selected period of reciprocation within a wide range of periods.

As shown in FIG. 6, when the thruster is in its lowermost position (FIG. 2) the drive lugs 58 are positioned in engagement with the cam surfaces 92 of the inner cam barrel 54. Ramp surface 96 of the outer cam barrel 52 transfers the drive lug 58 from engagement with cam surface 90 into engagement with the cam surface 92 of the inner cam barrel 54 as the driving barrel 56 rotates relative to the inner and outer cam barrels. A radially outer end 94 of the driving lug 58 engages ramp surface 96 and forces lug 58 inwardly to the position shown. An interfacing ramp surface 98 in the inner cam barrel 54 allows for receipt of the driving lug 58.

As the driving barrel 56 continues to rotate in the clockwise direction indicated by arrow 99, the drive lugs are caused to move along the cam surface 92 of the inner cam barrel 54 thereby urging the inner cam barrel 54 in an upward direction carrying the entire thruster 38 upwardly. As the thruster approaches its uppermost position, the drive lugs 58 are transferred into the position shown in FIG. 7 by a ramp surface 100 in the inner cam barrel 54 by means of the radial engagement between the ramp surface 100 and a radially inward end 102 of the cam lug 58. An interfacing ramp surface 104 in the outer cam barrel 52 allows for receipt of the drive lug 58 into engagement with the cam surface 90 of the outer cam barrel 52. At this point the thruster 38 would be in its highest position as shown in FIG. 5.

As the agitator continues to oscillate and the drive barrel 56 continues to rotate in a clockwise direction, the drive lugs 58 in engagement with the cam surface 90 of the outer cam barrel 52 will cause the outer cam barrel 52 and thus the entire thruster assembly 38 to move downwardly until the thruster assembly has reached its lowest position as shown in FIGS. 2 and 6. This up and down movement will be continuously repeated.

Figure 5:
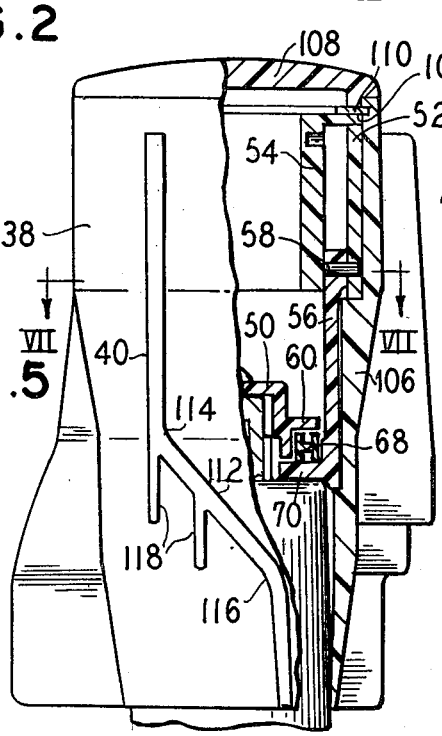
FIG. 5 is a partial side sectional view of the agitator thruster shown in FIG. 2.

As seen in FIG. 5, the thruster assembly 38 is comprised of the driving barrel 56 captured between the inner cam barrel 54 and outer cam barrel 52. An outer thruster shell 106 encompasses the entire assembly and a removable cap 108 provides a cover. The outer cam barrel 52 is permanently secured to the outer shell 106 to comprise essentially a single unit. The inner cam barrel 54 is indexed by a plurality of pins 109 (one being shown) and secured coaxially with the outer cam barrel 52 by means of a retaining means or snap ring 110 such that the transfer areas consisting of the interfacing ramps are aligned. The thruster vanes 40 are comprised of a main vane 112 which extends generally vertically downwardly and then curves as at 114 to a downwardly sloped region which curves again at 116 into a more vertically downwardly disposed section. A plurality of vertically downwardly disposed fingers 118 are provided beneath the sloped portion of the main vane 112.

As the thruster reciprocates up and down, the thruster vanes drive the clothes downward along the agitator barrel to the pumping vanes 36 at the lower portion of the agitator 26. The sloped portion of the thruster vane allows the thruster to move upwardly without pulling clothes with it and the downward dependent finger portions 118 assist the vanes in driving the clothes downwardly while the thruster is moving in a downward direction.

Thus, an agitator thruster for an automatic washer agitator is provided wherein the reciprocating motion in the thruster is obtained by inner and outer cam surfaces wherein a driving barrel has lugs which alternately transfer to the inner and outer cam surfaces.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In an automatic washer having a basket for receiving clothes to be washed, an agitator means within said basket for agitating the clothes during a wash cycle, said agitator means including an upper portion, and motor means drivingly connected to said agitator, a secondary agitation means mounted on said agitator for enhancing roll-over of said clothes in said basket during agitation, said secondary agitation means comprising:

one-way drive means driven by said motor means;

a driven barrel surrounding said upper portion of said agitator, said driven barrel having vane means on an exterior portion for forcing clothes downwardly along said upper portion of said agitator, said driven barrel further provided with an inner cam surface and an outer cam surface, said cam surfaces arranged for opposite vertical movement of said driven barrel between a first and second position;

a driving barrel drivenly connected to said one-way drive means, a driving pin means carried by said driving barrel, said pin means alternatively engageable with said cam surfaces for driving said driven barrel between said first and second positions;

means on said driven barrel for shifting said driving pin from one of said cam surfaces to the other of said cam surfaces at said first and second positions; and means provided on said driving barrel for restraining rotational movement of said driven barrel, whereby said driven barrel reciprocates vertically about said upper portion of said agitator in an intermittent manner when said agitator is driven in agitation by said motor means.

2. In an automatic washer having a basket for receiving clothes to be washed, an agitator means within said basket for effecting primary agitation of the clothes during a wash cycle, and motor means connected by a drive shaft to said agitator, a secondary agitation means mounted on an upper portion of said basket during agitation, said secondary agitation means comprising:

one-way clutch means connected to said drive shaft;

a drive cylinder drivingly connected to said drive shaft through said one-way clutch means;

a drive pin carried by said drive cylinder and oriented along a radial line of said drive cylinder;

an agitator thruster having an inner cylindrical portion and a spaced outer cylindrical portion forming an annular space therebetween;

said inner cylindrical portion having a spiral cam surface formed on an outer circumference and said outer cylindrical portion having a reverse spiral cam surface formed on an inner circumference;

said cylindrical portions further having transfer areas consisting of interfacing ramps;

said drive cylinder positioned in said annular space between said inner and outer cylindrical portions with said drive pin arranged to alternately engage said spiral and reverse spiral cam surfaces, and means provided on said drive cylinder for retarding rotation of said thruster, whereby said agitator thruster is caused to reciprocate vertically in an interrittent manner as said drive shaft oscillates.

3. The device of claim 2, wherein said agitator thruster has a plurality of vanes on an exterior surface for forcing clothes downwardly along said upper portion of said agitator during downward vertical movement of said thruster.

4. The device of claim 3, wherein said vanes are comprised of a main vane having an upper and lower portion substantially vertical and a central portion sloped downwardly connecting said upper and lower portions and having a plurality of fingers depending downwardly from said sloped central portion.

5. A means for converting oscillatory rotation into vertical reciprocating motion comprising:

an oscillating drive shaft;

one-way clutch means connected to said drive shaft;

an open top drive cylinder drivenly connected coaxially to said drive shaft though said one-way clutch mechanism;

a driving pin carried by said drive cylinder and oriented along a radial line of said drive cylinder;

a driven open bottom cylinder having an outer wall and a spaced inner wall;

said inner wall having a spiral cam surface formed on an outer circumference and said outer wall having a reverse spiral cam surface formed on an inner circumference for opposite vertical movement of said driven cylinder between a first position and a second position;

means on said driven cylinder for shifting and said driving pin from one of said cam surfaces to the other of said cam surfaces at said first and second positions, and means provided on said drive cylinder for retarding rotation of said driven cylinder, whereby said driven cylinder reciprocates vertically in an intermittent manner about said shaft when said shaft is oscillated.

6. The device of claim 5, wherein said means for shifting said driving pin comprises a transfer area consisting of interfacing ramps.

7. The device of claim 5, wherein said driven cylinder is constructed of three separate pieces being an outer shell, an outer cam cylinder and an inner cam cylinder which are indexed and secured coaxially to each other during operation.

* * * * *